US005819560A

United States Patent [19]

Grahovec et al.

[11] Patent Number: 5,819,560

[45] Date of Patent: Oct. 13, 1998

[54] PLASTIC LOCK

[75] Inventors: Duane B. Grahovec, Palos Park; James E. Krueger, Timley Park, both of Ill.

[73] Assignee: American Lock Company, Crete, Ill.

[21] Appl. No.: 643,035

[22] Filed: May 2, 1996

[51] Int. Cl.[6] ..... E05B 67/22

[52] U.S. Cl. ..... 70/38 A; 70/31

[58] Field of Search ..... 70/31, 37 AC, 70/38 R, 39, 51, 52; 220/4.21, 4.24, 656, 652; 403/375, 335, 336

[56] References Cited

U.S. PATENT DOCUMENTS

| | | | |
|---|---|---|---|
| 506,665 | 10/1893 | Browne et al. | 70/38 C |
| 572,115 | 12/1896 | Jackson et al. | 70/38 C |
| 2,048,570 | 7/1936 | Slaymaker | 70/38 C |
| 2,116,965 | 5/1938 | Schoorel et al. | 70/38 A |
| 2,550,655 | 4/1951 | Holan | 70/38 A |
| 2,691,288 | 10/1954 | Childs | 70/38 A |
| 3,143,872 | 8/1964 | Check | 70/38 A |
| 3,172,279 | 3/1965 | Patriquin | 70/38 A |
| 3,187,525 | 6/1965 | Dies | 70/38 A |
| 3,245,240 | 4/1966 | DeForrest . | |
| 3,713,309 | 1/1973 | Miller | 70/38 A |
| 3,952,903 | 4/1976 | Sanders et al. | 220/4.24 |
| 3,983,725 | 10/1976 | Manuel et al. . | |
| 4,098,100 | 7/1978 | Wah | 70/38 A |
| 4,111,475 | 9/1978 | McCormick et al. . | |
| 4,134,280 | 1/1979 | Pelavin . | |
| 4,138,868 | 2/1979 | Richards, Sr. | 70/38 A |
| 4,224,813 | 9/1980 | Hampton . | |
| 4,463,584 | 8/1984 | De Forrest . | |
| 4,502,305 | 3/1985 | Bakker . | |
| 4,639,978 | 2/1987 | Boden . | |
| 4,826,005 | 5/1989 | Tajima et al. | 220/4.24 |
| 4,850,209 | 7/1989 | Weinerman et al. . | |
| 4,881,387 | 11/1989 | Kortenbrede . | |
| 4,938,039 | 7/1990 | Tzung-I . | |
| 4,998,422 | 3/1991 | Borgmann et al. . | |
| 5,065,603 | 11/1991 | Kloke . | |
| 5,152,248 | 10/1992 | Ling | 70/25 |
| 5,174,136 | 12/1992 | Thwing . | |
| 5,228,320 | 7/1993 | Liou . | |
| 5,236,527 | 8/1993 | Brodsky . | |
| 5,275,027 | 1/1994 | Eklof et al. | 70/14 |
| 5,314,219 | 5/1994 | Georgopoulos et al. . | |
| 5,363,678 | 11/1994 | Meckback . | |
| 5,377,511 | 1/1995 | Meckbach . | |
| 5,427,423 | 6/1995 | Georgopoulos . | |
| 5,492,346 | 2/1996 | Stadler et al. . | |
| 5,520,032 | 5/1996 | Ling | 70/25 |

*Primary Examiner*—Steven N. Meyers
*Assistant Examiner*—Tuyet-Phuong Pham
*Attorney, Agent, or Firm*—Hill & Simpson

[57] ABSTRACT

A padlock having a U-shaped rigid shackle, a pair of locking balls, a rotatable retainer, and a lock cylinder held into a two piece composite plastic lock body. The two piece lock body can be ultrasonically welded together to capture the mechanical parts inside. The shackle can be metal such as steel, as can be the other mechanical parts. A lightweight, inexpensive yet reliable medium security lock is thus provided. The lock can be used as a safety lock out device or it can be used as a padlock for medium security applications.

18 Claims, 3 Drawing Sheets

PLASTIC LOCK

BACKGROUND OF THE INVENTION

The present invention relates to padlocks and particularly to pad locks having a U-shaped shackle partially separable from a lock body.

Padlocks having a U-shaped shackle extending from an openable tabular shaped lock body are known and described in, for example, U.S. Pat. Nos. 5,377,511; 5,363,678; 4,938,039; 4,998,422; and 5,174,136. Such padlocks provide a lock body having two cylindrical cavities through a top side, both in communication with a retainer cavity which holds two lock balls and a rotatable retainer. The shackle legs include inwardly directed cavities which by engagement with the locking balls prevent the upward movement of the shackle. The retainer cavity is open to a third cylindrical cavity penetrating longitudinally from a bottom side. This third cavity holds a lock cylinder assembly. The lock cylinder assembly receives a key from a bottom side through a keyway. When rotated by a correct key, the cylinder causes the rotation of an actuator which rotates the retainer to retract the balls. This allows the shackle to be retracted upwardly to open a lock. One leg of the shackle includes a 360° recess to allow rotation of the shackle around one locking ball, which also prevents removal of the shackle from the lock body.

Known padlocks of the above described configuration typically use a steel brass or aluminum lock body. This provides a rugged and secure lock to prevent forced removal. However, there are applications were other considerations predominate to maximum security, such as lightweightness, convenience, low cost, and corrosive resistance.

Also known are security seals or safety lock out devices which are used for locking a closure, and if broken, indicate that an unauthorized access has occurred. These devices can be used to lock out panel doors, or switches or controls or other parts of machinery. These devices can also prevent the inadvertent or unintentional access by requiring an intentional breakage to gain access. Such security devices are disclosed for example in U.S. Pat. Nos. 5,427,423 and 5,314,219. These devices typically are low cost devices which are used one time and are destructively removed, i.e., they are not key operated for removal. U.S. Pat. No. 4,502,305 describes a security device which is key operated but which uses a flexible J-shaped plastic shackle which lacks a degree of structural toughness of the aforementioned U-shaped metallic shackle.

SUMMARY OF THE INVENTION

It is an object of the invention to provide a lightweight padlock. It is an object of the invention to provide a padlock which can be produced at low cost but retains effectiveness for its particular application. It is an object of the invention to provide a padlock which can be used more effectively in a corrosive environment.

It is an object of the invention to provide a padlock which can be used as a safety lock out device and which can be key operated for removal. It is an object of the invention to provide a safety lock out device which has an electrically non-conductive lock body. It is an object of the invention to provide a safety lock out device which can be repeatedly used. It is an object of the invention to provide a safety lock out device which is structurally resistive to removal by unauthorized personnel.

It is an object of the invention to provide a padlock for use in controlled environments such as penitentiaries or institutions which provides a medium degree of security for personal item security, such as gym lockers, but which are also lightweight so as to reduce a potential use as a projectile weapon by inmates or patients. It is an object of the invention to provide a low cost manufactured lock for reduced security applications, where security against massive-force tampering, such as by sledgehammer or lock cutters, or other tools, is not a great concern, or where the items secured are not extremely valuable such as for school gym lockers, school lockers, supply cabinets, etc.

The objects of the invention are achieved by a padlock composed of a plastic lock body which retains a locking ball to retain a U-shaped shackle. The lock body is effectively manufactured by injection molding two body half shells which are non-removably welded together to complete the enclosed lock body. The plastic lock body is electrically non-conductive for additional safety as a lock out device. The plastic lock body is resistive to corrosion as compared to aluminum or steel. The locking balls and shackle can be metallic, such as steel, to increase tampering security over an all plastic safety lock-out device which can be severed easily at a plastic shackle. The lock provides the U-shaped shackle is openable by key activation and rotatable on the lock body for opening.

The lock provides a greatly reduced lock weight over typical steel lock bodies and a softness increase and cost advantage over aluminum lock bodies. The lock is suitable for use as a security device in a controlled environment such as penitentiaries or mental health institutions because its lightweightness reduces its destructive potential as a projectile weapon. The plastic lock body is made significantly hollow with reinforcing ribs for structural strength and integrity.

The lock body is advantageous composed of fiberglass reinforced plastic such as polypropylene or nylon 6/6 with glass fibers at 30–50%. Advantageously polypropylene with 40% long glass fibers can be used. The addition of a chemical coupling agent improves physical properties over standard glass reinforced compounds. This material has resistance to chemicals, thermal aging and has a low moisture absorption.

The inventive plastic lock body is thus advantageous for a low cost medium security padlock and also as a safety lock-out device which requires minimal security since the purpose is to provide lock-out protection for machinery. The material cost is less than a comparable metal lock body and scrap is minimal since the body is injection molded.

The plastic composite provides improved resistance to chemical attack as well as improved resistance to galvanic corrosion. The part geometry of the lock body allows all components to be placed in position during assembly before the lock body is welded together, rear shell to front shell. This creates a unit which cannot be altered without damaging the assembled lock.

DETAILED DESCRIPTION OF THE PREFERRED EMBODIMENTS

Figure 1:
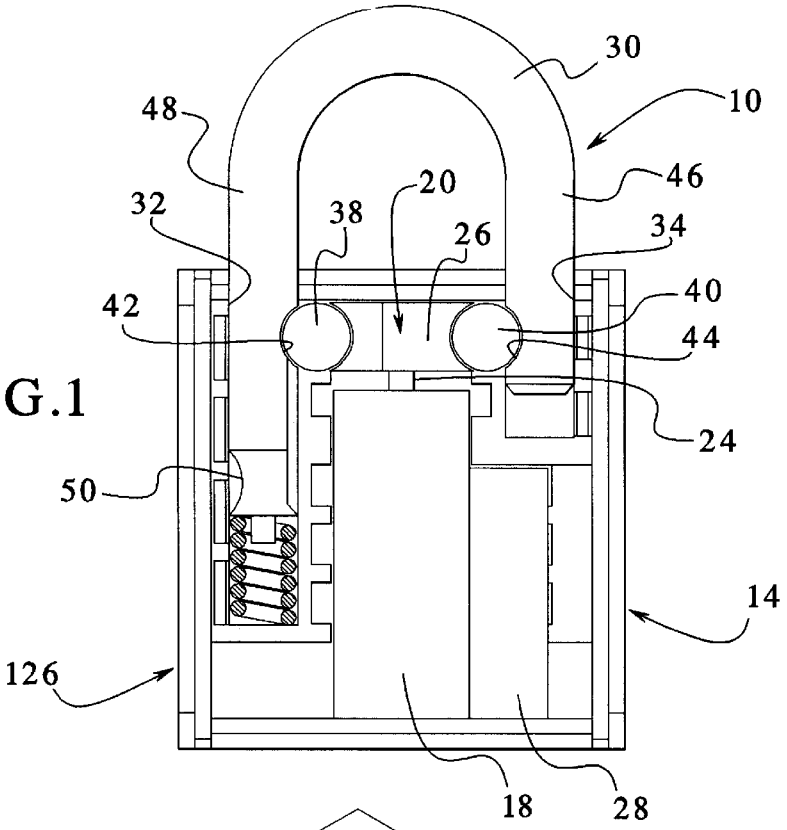
FIG. 1 is an elevational view of a padlock of the present invention partially assembled.

FIG. 1 illustrates in elevational view a padlock 10 of the present invention partially assembled. The lock 10 includes a lock body 14 (showing one half shell portion) containing a lock cylinder 18 engageable to a retainer assembly 20. When the correct key is inserted and turned inside the cylinder 18, a tail piece 24 is turned, which turns a rotator bolt 26. A cylinder "bible" 28 which holds the spring pins which define the correct key extends laterally from the cylinder 18. The bible 28 is tabular shaped and is clamped in place to prevent rotation of the cylinder 18. A U-shaped shackle 30 is held in a first bore 32 and a second bore 34 of the lock body 14, by locking balls 38, 40 held within the body.

The balls 38, 40 are held in recesses 42, 44 formed on inside surfaces of the shackle 30. When the bolt 26 is turned, the balls 38, 40 can move away from the shackle to allow upward movement of the shackle. A short leg 46 of the shackle can be completely removed from the lock body 14. A long leg 48 can only move upward until a circumferential groove 50 receives the locking ball 38 and the long leg 48 is retained in the body 14 thereby. The shackle 30 can rotate about the vertical axis of the long leg 48 as the ball 38 moves around the groove 50.

Details of locking cylinder and retainer assemblies can be derived from U.S. Pat. Nos. 5,377,511; 5,363,678; 4,938,039; 4,998,422; and 5,174,136, herein incorporated by reference.

FIGS. 2–7 illustrates the lock body of the present invention. The lock body 14 is composed of a reinforced plastic such as a composite plastic with embedded glass fibers. Advantageously, a polypropylene with 40% long glass fibers is used. Also, a nylon 6/6 with 30% short glass fibers or 50% long glass fibers can be used as well.

The lock body 14 of the present invention is injection molded in two half shells, front and back and the two half shells are ultrasonically welded together after the mechanical parts are installed, such as retainer assembly 20, cylinder 18, locking balls 38, 40, and shackle 30.

Figure 2:
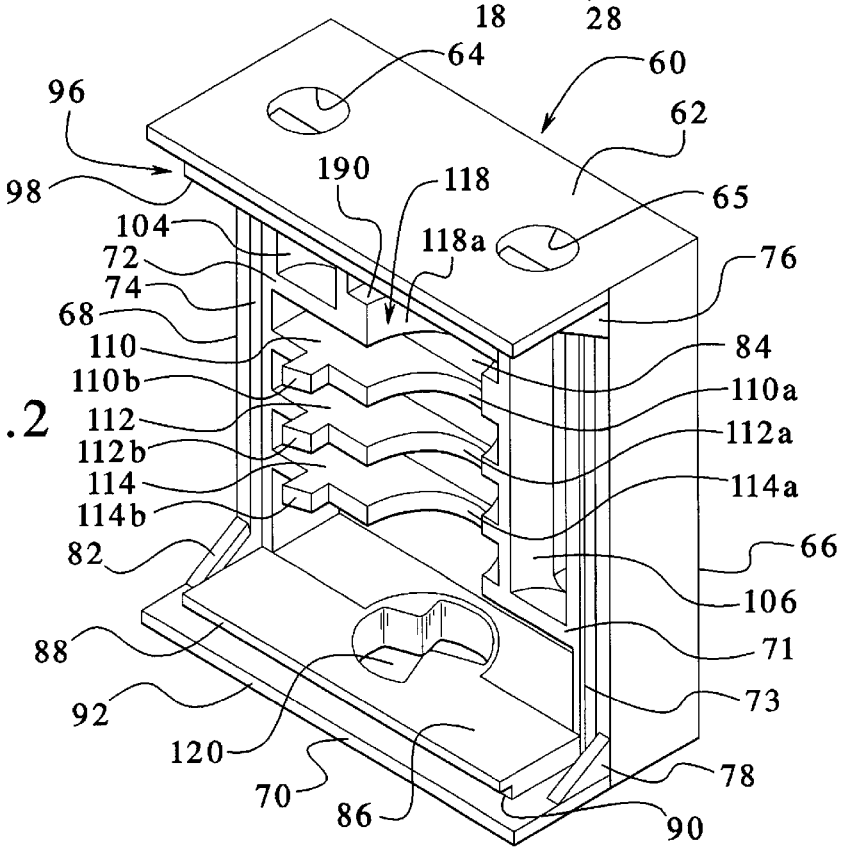
FIG. 2 is a rear perspective view of a front half shell of a lock body of the embodiment of FIG. 1.

As illustrated in FIG. 2, a front half shell 60 of the lock body 14 provides a top plate 62 having a first hole 64 for receiving the shackle short leg 46, and a second hole 65 for receiving the shackle long leg 48. The top plate 62 connects at opposite sides to a first side plate 66 and a second side plate 68. The side plates are connected by a bottom plate 70. First and second inner side plates 71, 72 are recessed forwardly of the side plates 66, 68. Between inner side plate 71 and first side plate 66 is a vertical slot 73. Between inner side plate 72 and second side plate 68 is a vertical slot 74. The top plate 62 and bottom plate 70 overhang the side plates 66, 68, extending rearwardly. The side plates 66, 68 are connected at the top and bottom plates with triangular gusset plates 76, 78, 80, 82. A front wall 84 connects the top, bottom and sides of the shell 60.

Formed with a bottom plate 70 is a floor plate 86 having a tongue 88 and groove 90. The floor plate 86 is recessed from a rear edge 92 of the bottom plate 70.

The top plate 62 has formed on its underside a ceiling plate 96 which has a tongue 98 and groove 100, similar to the tongue 88 and groove 90 of the floor plate 86.

Beneath the first hole 64 is a short half-cylinder cavity 104; and beneath the second hole 65 is formed a long half-cylinder cavity 106. These cavities receive the shackle legs 46, 48 respectively. A plurality of ribs 110, 112, 114 are arranged horizontally and spaced apart between the second inner side plate 72 and the long half cylinder cavity 106. These ribs serve to strengthen the lock body against external forces such as a crushing force, and also guide the cylinder 18 within the lock body 14. Semicircular cut outs 110*a*, 112*a*, 114*a* guide a circular key housing 18*a* of the cylinder, while tabs 110*b*, 112*b*, 114*b* retain the key cylinder "bible" 28 or pin housing, against rotation by coacting with an opposite half shell of the body 14. A top rib 118 connects the cavities 104, 106 and includes a semicircular recess 118*a* for additionally guiding the cylinder.

An "8" shaped keyhole 120 is formed through the floor plate 86 and bottom plate 70 to allow insertion of a key to operate the cylinder 18. The first and second holes 64, 65 also pass through both the top plate 62 and ceiling plate 96.

Figure 3:
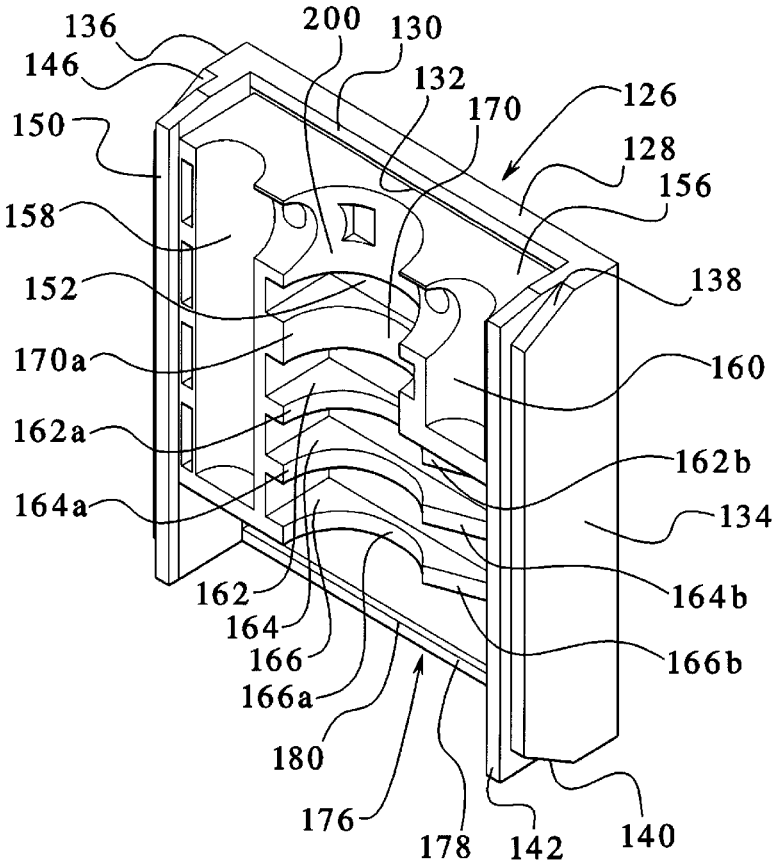
FIG. 3 is a front perspective view of a back half shell of the lock body of the embodiment of FIG. 1.

FIG. 3 illustrates a rear half shell 126 of the body 14. A top ridge 128 provides a forwardly facing tongue 130 and groove 132. The ridge 128 connects to a first side plate 134 and a second side plate 136. The first side plate 134 has triangular recesses 138, 140. A first inner side plate 142 extends forwardly of the first side plate 134. The second side plate 136 also has triangular recesses 146, 148 and a second inner side plate 150 extending forwardly thereof. A rear wall 152 connects the top, bottom, and sides of the shell 126. Extending from a top ledge 156 is a long semi-cylindrical recess 158 and a short semi-cylindrical recess 160.

Three horizontal ribs 162, 164, 166 extend between the long semi-cylindrical recess 158 to the first inner side plate 142. A top rib 170 connects the two cavities 158, 160. Semi-circular recesses 170*a*, 162*a*, 164*a*, 166*a* guide the cylinder 18 when installed. Adjacent the semi-circular recesses 162*a*, 164*a*, 166*a* are angled edges 162*b*, 164*b*, 166*b*. The angled edges and the tabs 110*b*, 112*b*, 114*b* clamp the cylinder bible therebetween to prevent rotation of the cylinder 18 with respect to the body 14. Between the first and second inner side plates 142, 158, at a bottom thereof, is a bottom ridge 176 having a tongue 178 and groove 180.

Figure 4:
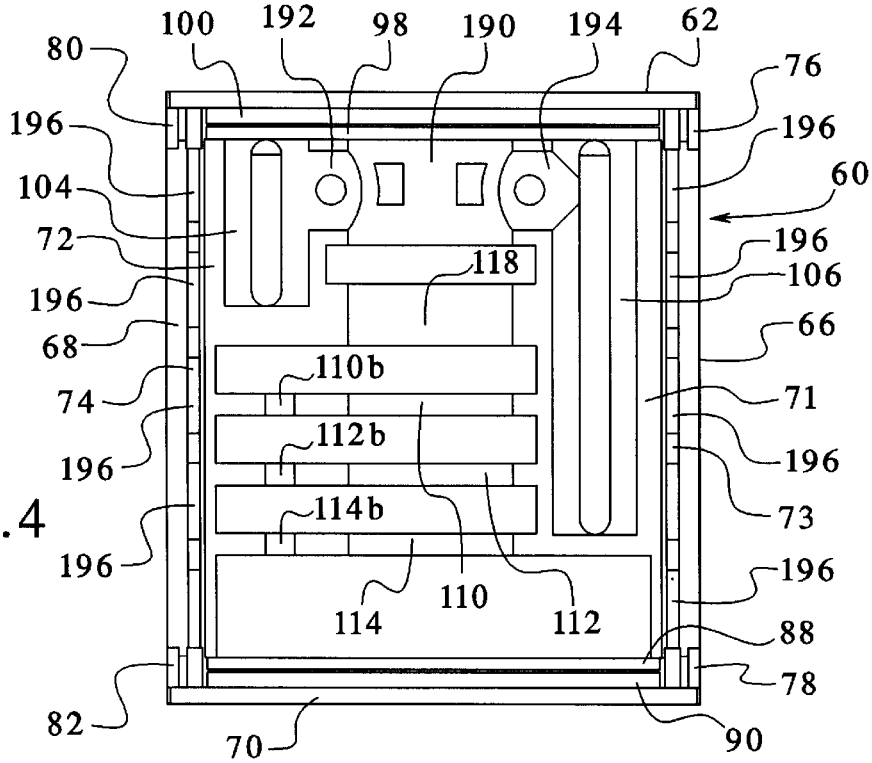
FIG. 4 is a rear view of the lock body half shell shown in FIG. 2.

As illustrated in FIG. 4, the front half 60 includes a semi-cylindrical cavity 190 which houses the rotatable bolt 26 of the retainer assembly 20. Side cavities 192, 194 hold the locking balls 38, 40 and are open between the semi-cylindrical cavity 190 and the short and long cavities 104, 106. The slots 73, 74 are shown between the inner and outer side plates. Further voids 196 are formed to reduce molding thicknesses to accommodate shrinking defects and reduces weight.

Figure 5:
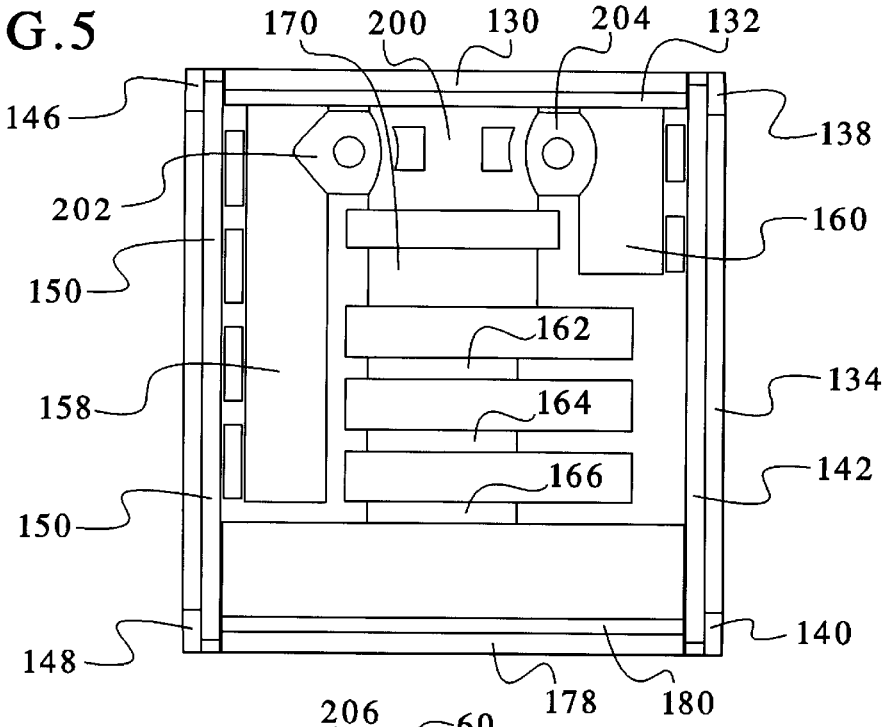
FIG. 5 is a front view of the lock body half shell shown in FIG. 3.

As illustrated in FIG. 5, the rear half body shell 126 includes a semi-cylindrical recess 200 for housing the rotatable bolt 26, and side recesses 202, 204 open therewith and with the short and long cavities 160, 158. The side recesses hold the locking balls 38, 40.

Figure 6:
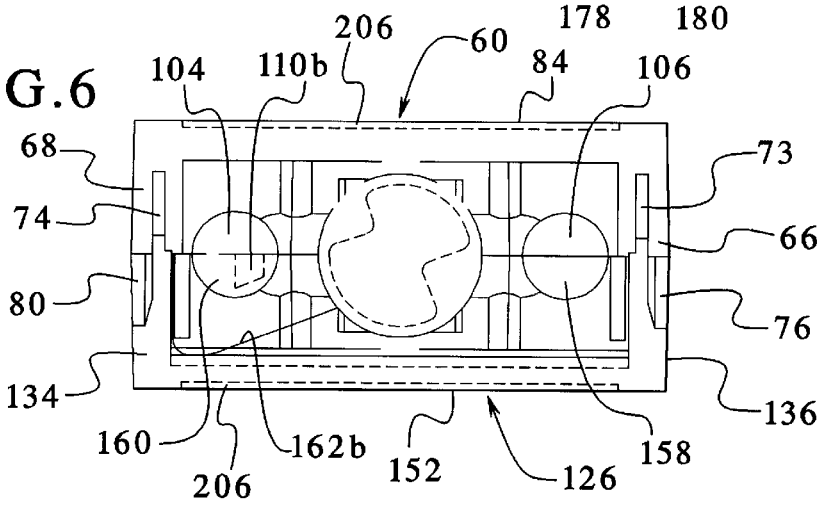
FIG. 6 is a top view of the assembled lock body half shells with a top plate removed for clarity.
Figure 7:
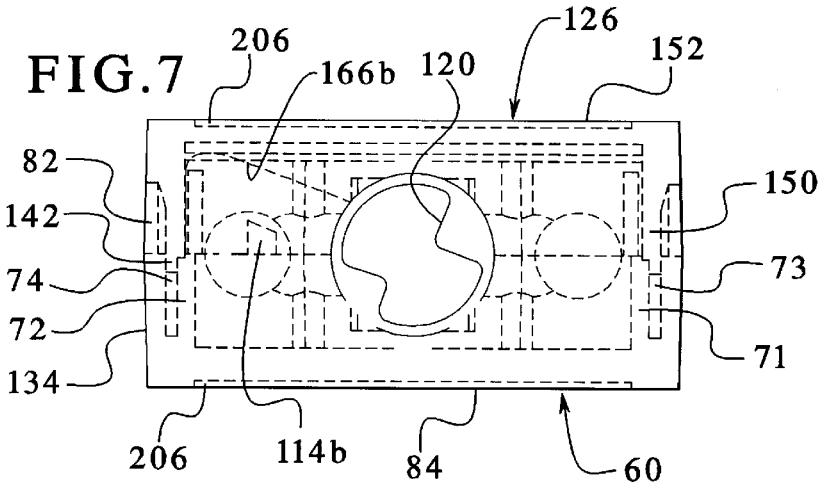
FIG. 7 is a bottom view of the assembled lock body half shells.

FIGS. 6 and 7 illustrate the front and rear shells 60, 126 connected together. When the front half shell 60 is mated with the rear half shell 126, the tongues 130, 178 interfit into the grooves 100, 90 respectively as the top plate 62 and bottom plate 70 overlie the ridges 128, 176. The gusset plates 76, 78, 80, 82 interfit into the triangular recesses 138, 140, 146, 148 as the inner plate 142, 150 insert into the slots 73, 74 and abut the side plates 71, 72, forming tongue-in-groove joints. The ribs 170, 162, 164, 166 and complementary ribs 118, 110, 112, 114 meet to form circular guides. The tabs 110*b*, 112*b*, 114*b* and edges 162*b*, 164*b*, 166*b* clamp the cylinder bible in place within the lock body 14. The front and rear half shells 60, 126 are provided with recesses 200 on the outside of the lock body 14 as shown in FIGS. 6 and 7. The recesses 206 are formed on the outside of the front and rear walls 84, 152. The recesses 206 provide a convenient location for adhering labels to the plastic lock.

The two piece body 14 is then ultrasonically welded at its tongue-in-groove joints to form an integral assembly. Alternatively, other methods of joining the two half shells can be used such as adhesively securing.

The thus formed lock is fracture resistant and tough, with reinforcing against crushing and cracking. It is efficiently and cost effectively assembled. It is electrically non-conductive through its body. It provides a secure U-shaped shackle arrangement for locking. The shackle can be steel for resistance to cutting, as can the other mechanical components such as the cylinder, locking balls, and retainer assembly, all held by the plastic lock body.

Although the present invention has been described with reference to a specific embodiment, those of skill in the art will recognize that changes may be made thereto without departing from the scope and spirit of the invention as set forth in the appended claims.

I claim as my invention:

1. A padlock, comprising:

a U-shaped shackle having a long leg and a short leg;

a lock body having a first recess which receives the long leg and a second, recess which receives the short leg;

a retainer assembly;

a locking ball engaged to said retainer assembly and lockable to said short leg;

a lock cylinder engaged to said retainer assembly and key activated to selectively release said short leg from said locking ball;

said lock body providing a center recess which holds said retainer assembly and said cylinder and a side recess which holds said locking ball; and said lock body is substantially composed of plastic first and second shells connected together at a seam;

wherein at least a portion of the seam is formed by the first shell having first and second edges spaced apart from each other and offset from each other defining a groove, the first shell having an end plate having the first edge, the end plate adjacent an inside plate having the second edge, the end plate and inside plate spaced apart from each other by the groove, the second edge offset inwardly from the first edge, and the second shell having a protrusion received in the groove.

2. The padlock according to claim 1, wherein said plastic is a composite material having reinforcing fiber.

3. The padlock according to claim 1, wherein said shackle is composed of metal.

4. The padlock according to claim 1, further comprising a second locking ball engageable to said long leg of said shackle to allow said long leg to raise when said lock is key disengaged, but which retains said long leg into said lock body.

5. The padlock according to claim 4, wherein said first and second balls are located on opposite sides of said retainer assembly.

6. The padlock according to claim 1, wherein each shell iIs separately injection molded.

7. The padlock according to claim 1, wherein said lock body is formed of said shells, with two side seams and top and bottom seams, said side and top and bottom seams comprising lapped seams which are ultrasonically welded together.

8. The padlock according to claim 7, wherein the lapped seams comprise tongue-in-groove seams.

9. The padlock according to claim 1, wherein said lock cylinder comprises a lock cylinder bible holding pins therein, and said shells comprise a recess for clamping said lock cylinder bible therebetween to prevent rotation thereof with respect to said lock body, when said shells are assembled together.

10. The padlock according to claim 1, wherein said lock body has opposed top and bottom surfaces in which at least one of the top and bottom surfaces is free of the seams between the plastic first and second shells.

11. The padlock according to claim 1, wherein the first shell comprises:

left and right front side plates extending from a front wall;

top and bottom plates extending from the front wall, beyond the left and right front side plates; and gussets extending from the top plate to the left and right front side plates and from the bottom plate to the left and right front side plates.

12. The padlock according to claim 11, wherein the second shell comprises left and right rear side plates extending from a rear wall, the left and right rear side plates defining gusset recesses which are aligned with the gussets.

13. A security lock out device, comprising:

a rigid U-shaped shackle;

a plastic lock body having first and second shells bonded together, the first shell having an end plate having an outer edge, the end plate adjacent an inside plate having an inside edge, the inner and outer edges spaced apart from each other to form a groove between the outer and inner edges and between the end plate and the inside plate, the outer edge extending past the inner edge, the second shell having a protrusion received in the groove and bonded to the first shell;

a means for releasably holding said U-shaped shackle into said lock body closing said U-shape shackle; and a keyed means for selectively releasing said U-shaped shackle to raise from said lock body to open said shackle.

14. The lock out device according to claim 13, wherein said shackle is composed of metal.

15. The lock out device according to claim 13, wherein said plastic body is composed of a fiber reinforced plastic.

16. A security lock out device according to claim 13, wherein the second shell defines a second groove and the inner edge on the inside plate is received in the second groove.

17. A padlock, comprising:

a U-shaped shackle having a long leg and a short leg;

a lock body having a first recess which receives the long leg and a second recess which receives the short leg;

a retainer assembly;

a locking ball engaged to said retainer assembly and lockable to said short leg;

a lock cylinder engaged to said retainer assembly and key activated to selectively release said short leg from said locking ball;

said lock body providing a center recess which holds said retainer assembly and said cylinder and a side recess which holds said locking ball; and said lock body is substantially composed of plastic first and second shells connected together at a seam, the first shell having left and right front side plates extending from a front wall, top and bottom plates extending from the front wall beyond the left and right front side plates, and gussets extending from the top plate to the left and right front side plates and from the bottom plate to the left and right front side plates.

18. The padlock according to claim 17, wherein the second shell comprises left and right rear side plates extending from a rear wall, the left and right rear side plates defining gusset recesses which are aligned with the gussets.

* * * * *